United States Patent [19]

Sieberth et al.

[11] Patent Number: 4,856,454

[45] Date of Patent: Aug. 15, 1989

[54] APPLICATOR MECHANISM FOR COATING RUNNING WEBS

[75] Inventors: Ralf Sieberth, Appleton, Wis.; Hans-Peter Sollinger, Heidenheim, Fed. Rep. of Germany

[73] Assignee: J.M. Voith GmbH, Heidenheim, Fed. Rep. of Germany

[21] Appl. No.: 187,265

[22] Filed: Apr. 28, 1988

[30] Foreign Application Priority Data

May 8, 1987 [DE] Fed. Rep. of Germany ..... 3715307

[51] Int. Cl.[4] ..... B05C 11/02

[52] U.S. Cl. ..... 118/126; 118/119

[58] Field of Search ..... 118/119, 126, 246

[56] References Cited

U.S. PATENT DOCUMENTS

| | | | |
|---|---|---|---|
| 2,312,927 | 3/1943 | Murray | 118/126 X |
| 2,678,890 | 5/1954 | Leighton | 427/362 |
| 3,097,107 | 7/1963 | Marjenek | 118/126 X |

OTHER PUBLICATIONS

"Wochenblatt für Papierfabrikation", 1986, p. 267.

*Primary Examiner*—Shrive Beck
*Assistant Examiner*—Alain Bashore
*Attorney, Agent, or Firm*—Albert L. Jeffers; Richard L. Robinson

[57] ABSTRACT

A rough dosing point with applicator roll 2 is provided which relative to the opposed roll 1 forms a rough dosing gap 6. Located some distance from the rough dosing device is a finish dosing device which comprises a blade element 5 and an opposed roll 4. The web runs through a reversing roll 9 between the rough dosing gap 6 and the point of finish dosing, the distances of the web departure point from the opposed roll 1, of the rough dosing gap 6, and the run-on point of the web on the opposed roll 4 of the finish dosing point given through the blade element 5 being relatively short. The reversing roll having a maximum diameter of 300 mm, and the arcuate course of the web curving at said reversing roll at an angle of reversal between 25° and 60°.

4 Claims, 1 Drawing Sheet

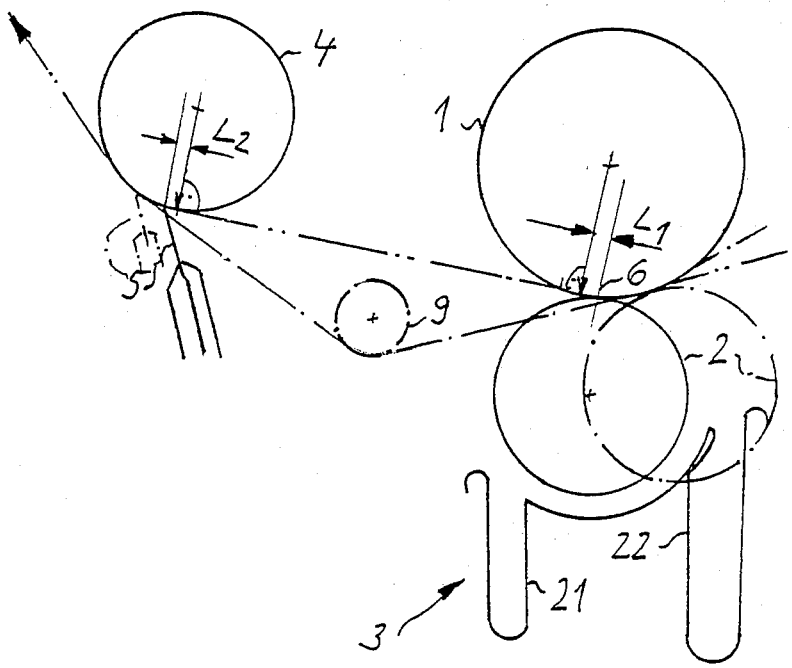
4
1
L2
L1
6
5
9
2
22
21
3

APPLICATOR MECHANISM FOR COATING RUNNING WEBS

BACKGROUND OF THE INVENTION

The invention concerns an applicator mechanism for the coating of running webs with a rough dosing device and a finish dosing device featuring a blade element. The customary applicator mechanisms with a rough dosing and a finish dosing device, such as known for instance from "Wochenblatt für Papierfabrikation," 1986, page 267, feature an applicator roll which receives the coating substance either from a transfer roll or directly from a coating mixture sump and an opposed roll, with the applicator roll and opposed roll forming a rough dosing gap through which passes the web, and features finally a blade element which after a specific travel of the web, while the latter is still being supported by the guiding opposed roll, effects the finish dosing of the coating application. It is disadvantageous that the web negotiates a rather sharp curvature between the rough dosing gap and the finish dosing point of the blade element, so that strong centrifugal forces occur which throw the coating mixture off the web. This process being relatively disuniform, the result is often a disuniform finish coating application. Known from U.S. Pat. No. 2,678,890 is a coating mechanism with a rough dosing device that features an applicator roll which is immersed in a coating mixture sump. But absent here is the opposed roll to the applicator roll and, furthermore, the blade element is an air blade which is arranged approximately in the center of the web loop around the pertaining opposed roll.

The problem underlying the invention is to design such a coating mechanism in such a way that irregularities in the coating application will be avoided to the maximum extent prior to the finish coating. This problem is solved through the features of the present invention.

SUMMARY OF THE INVENTION

The invention involves a relatively sharp reversal of the web between the two opposed rolls which avoids disuniformities by causing a relatively uniform dumping of at least part of the excess coating mixture.

DESCRIPTION OF THE PREFERRED EMBODIMENTS

The invention will be explained hereafter with the aid of a sketch shown in the figure. Marked 1 is the opposed roll of the rough dosing device, where by means of the applicator roll 2 a dosing gap 6 is formed on the opposed roll where the web first is rough-coated, with the applicator roll running in an applicator tub 3 provided with an inlet channel 21 and a drain channel 22. The finish dosing occurs in the finish dosing device consisting of opposed roll 4 and blade element 5, with the web continuing, after the point of finish dosing (contact line of the coating blade 5), to loop for a certain distance around the opposed roll 4 and then running off it. The web run is straight between the rough dosing gap 6 and the finish dosing point, so that radial accelerations that might cause a throw-off of coating mixture are nonexistent.

Another embodiment avoids the straight web travel through the use of a sharp reversal point, which is given here through the reversing roll 9. This variant is shown by broken line, noting here also the changed position of the applicator roll 2. Otherwise, the web travel is straight and a strong, but also relatively uniform throw-off of at least part of the excess applied coating substance takes place only on the reversing roll 9, due to the strong centrifugal force effect. Hence, the coating that remains on the web after its sharp reversal continues to be uniform or becomes even more so.

For the centrifugal force caused by the reversal to be sufficiently strong, the diameter of the reversing roll 9 should amount to maximally 300 mm and the arcuate angle of reversal (loop angle) about 30° to 60°.

As illustrated here, the parting point is located a certain distance $L_1$ from the dosing gap 6 and the run-on point a certain distance $L_2$ from the finish dosing point, each viewed in the direction of web travel. These distances are so short that they will not lead to any long period of centrifugal force effect on the coating mixture that might result in a harmful disuniformity of the latter. These distances $L_1$, $L_2$, should be kept maximally short and approach zero. The preferred condition is that $L_{1,2} \leqq 0.12\ D_{1,2}$, with $0.05\ D_{1,2} \leqq L_{1,2} \leqq 0.08\ D_{1,2}$ being the preferred range, where D is the diameter of the respective opposed roll.

What is claimed is:

1. Applicator mechanism for the coating of running webs comprising:

a rough dosing device having a first opposed roll from which the web departs at a departure point, and having an application point;

a finish dosing device having a second opposed roll onto which the web runs at a run-on point, and having a blade element cooperating with the second opposed roll to define a finish dosing point;

said rough dosing device having a distance $L_1$, defined from the application point to the departure point;

said finish dosing device having a distance $L_2$ defined from the run-on point to the finish dosing point;

wherein the condition applies that $L_{1,2} \leqq 0.12\ D_{1,2}$, where $L_{1,2}$ are measured each in the direction of web run and $D_{1,2}$ are the diameters of the first and second opposed rolls, respectively; and a reversing roll engaging said web to form a sharp reversal point, at which the course of said web curves heavily while otherwise curving unnoticeably, said reversing roll having a maximum diameter of 300 mm, the course of said web curving at said reversing roll at an arcuate angle of reversal between 25° and 60°.

2. Applicator mechanism according to claim 1, in which the condition applies that $0.05\ D_{1,2} \leqq L_{1,2} \leqq 0.08\ D_{1,2}$.

3. Applicator mechanism according to claim , 1 and further including an applicator roll cooperating with the first opposed roll of the rough dosing device to define therebetween a rough dosing gap through which passes said web, wherein the rough dosing point is the rough dosing gap.

4. Applicator mechanism according to claim 2, and further including an applicator roll cooperating with the first opposed roll of the rough dosing device to define therebetween a rough dosing gap through which passes said web, wherein the rough dosing point is the rough dosing gap.

* * * * *